United States Patent [19]

Gallagher

[11] Patent Number: 5,054,670

[45] Date of Patent: Oct. 8, 1991

[54] HOLSTER PADDLE

[76] Inventor: Richard N. Gallagher, 2019 W. Quail Ave., Phoenix, Ariz. 85027

[21] Appl. No.: 561,012

[22] Filed: Jul. 31, 1990

[51] Int. Cl.[5] ..... F41C 33/00

[52] U.S. Cl. ..... 224/191; 224/911; 224/912

[58] Field of Search ..... 224/911, 912, 191, 230, 224/193, 252; 150/134

[56] References Cited

U.S. PATENT DOCUMENTS

| | | | |
|---|---|---|---|
| 118,228 | 8/1871 | Frey | 224/911 |
| 2,138,978 | 12/1938 | Meine | 224/252 |
| 3,300,109 | 1/1967 | Clark | 224/252 |
| 3,902,639 | 9/1975 | Rogers | 224/912 |
| 3,915,361 | 10/1975 | Perkins | 224/151 |
| 4,424,924 | 1/1984 | Perkins | 224/252 |
| 4,667,374 | 5/1987 | Bianchi | 224/911 |

*Primary Examiner*—Linda J. Sholl
*Attorney, Agent, or Firm*—Tod R. Nissle

[57] ABSTRACT

A paddle for a holster. When the paddle is attached to the holster, the paddle slides over the belt and inside the waist of the pants of a user to bind the pants intermediate the paddle and holster. When the holster is grasped and pulled away from the body of the user, the paddle firmly engages the pants of the user to prevent the holster from being pulled free from the user's person.

4 Claims, 2 Drawing Sheets

HOLSTER PADDLE

This invention relates to holsters.

More particularly, the invention relates to a paddle which, when incorporated in a holster, slides over the belt and inside the waist of the pants of a user to bind the pants intermediate the paddle and holster and which, when another individual grasps and pulls the holster away from the waist of the user, firmly engages the pants to prevent the holster from being pulled free from the user.

A conventional holster paddle is described in Rogers U.S. Pat. No. 3,902,639. . The paddle is indicated by reference character 35 in FIGS. 2 to 7 of the Rogers patent and is attached to the upper part of one side of the holster. The paddle slides over the belt and inside the waist of the pants of the user, while the holster remains outside of the pants. Flanges 40, 41 (FIG. 2) or 53 (FIGS. 5, 6) are provided on the inside of the holster. These flanges or teeth are intended to engage the pant leg of the user to secure the holster to the pant leg. The flanges 40, 41, 53 described in the Rogers patent suffer from two important disadvantages. First, the flanges damage and wear the material in pants worn by a user. The damage caused by flanges 40, 41 and 53 to pants material is especially aggravating when the pant worn are of the more expensive variety. Second, and more important, the flanges 40, 41, 53 are not particularly effective in preventing an individual from pulling a holster from the waist of a user. As can be seen with reference to FIG. 2 in the Rogers patent, when the holster is pulled away from the body of the user, flanges or teeth 40, 42 are pulled away and disengaged from the pants leg. As a result, an individual can approach a user by surprise from behind and take the holster and gun from the user by pulling the holster out, up and off of the waist of the pants of the user. In law enforcement, the ability of a suspect to so remove a holster from a police officer is undesirable.

Accordingly, it would be highly desirable to provide an improved paddle which could be readily inserted over the waist belt and inside the waist of pants worn by a user and which would make ready removal of the holster from the user by another difficult.

Therefore, it is a principal object of the invention to provide an improved holster for pistols or other holsterable objects.

A further object of the invention is to provide an improved holster paddle which can be readily slipped over the belt and inside the waist of the pants of a user and which can be worn while minimizing damage to the user's clothing caused by the paddle.

Another object of the instant invention is to provide an improved holster paddle which, when a holster worn by a user is pulled away from the body of the user, engages and "locks" on the clothing of the user.

These and other, further and more specific objects and advantages of the invention will be apparent to those skilled in the art from the following detailed description thereof, taken in conjunction with the drawings, in which.

Briefly, in accordance with my invention, I provide an improved holster for pistols. The holster includes a pocket member shaped and dimensioned to slidably receive a pistol and including a first side normally positioned to face the body of the holster user and a second side normally positioned to face away from the body of the holster user; a mounting member insertable at the waist inside the pants of the holster user to position a portion of the pants intermediate the mounting member and the first side of the holster and including a first portion attached to the first side of the pocket member, a second portion attached to the first portion and extending downwardly over and spaced apart from the first side of the pocket member, and a third portion extending outwardly from the second portion against the first side of the holster. The third portion includes a planar surface positioned against the first side and includes edge means. The third portion is shaped and dimensioned such that when the mounting member is inserted at the waist inside the pants of the holster user, the planar surface is normally adjacent the first side and frictionally slidably engages and presses a portion of the pants against the first side. The edge means is normally adjacent the first side and frictionally slidably engages the portion of the pants. When the pocket member is pulled away from the body of the holster user and the third portion is tilted away from the body of the holster user the planar surface tilts away from the body of the holster user, and the edge means is tilted outwardly from the body of the holster user into the portion of the pants to increase the force exerted on the portion of the pants by the edge means and improve the engagement of the pants by the edge means.

Figure 1:
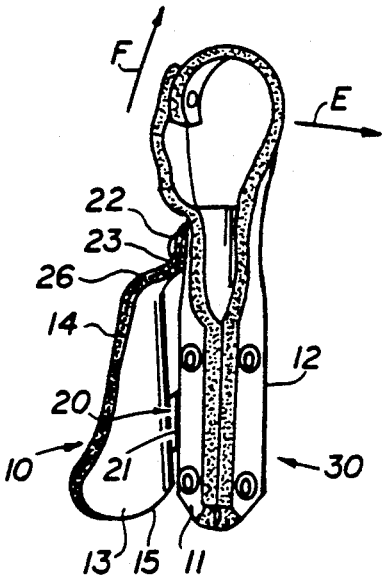
FIG. 1 is a side view illustrating a holster and paddle constructed in accordance with the principles of the invention.
Figure 2:
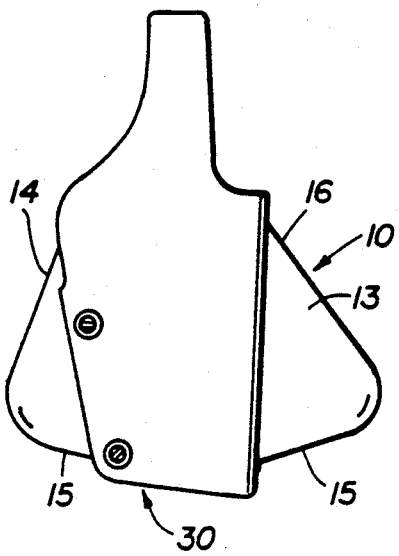
FIG. 2 is a rear view illustrating the holster and paddle of FIG. 1 and showing further construction details thereof.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 and 2 illustrate a paddle 10 which is constructed in accordance with the invention and is attached to a holster 30. The mounting member or paddle 10 is attached with screws 22 to the side 11 of the holster. When holster 30 is worn, side 11 faces the hip and body of the holster user the other side 12 of the holster faces away from the body of the holster user. The paddle 10 includes a first panel portion 23, a second clamshell portion including panel member 26 and an arcuate clamshell member having inner concave surface 31, outer convex surface 13, and peripheral edges 14, 15, and 16. As shown in FIG. 3 to 6, bend or elbow 25 interconnects panel portion 23 and panel member 26. Bend or elbow 27 interconnects panel member 26 and the arcuate clamshell member.

The third portion of paddle 10 comprises edge means or tooth 20. Edge means 20 includes smooth rectangular planar surface 21. Apertures 24 are formed through panel portion 23 to receive screws 22 (FIG. 2) which are utilized to fasten the mounting member or paddle 10 to holster 30. The sides 11, 12 of the holster form a pocket which is shaped and dimensioned to slidably receive a pistol, pair of handcuffs, cartridge pack, or other holsterable object. Typically, the holsterable object received by the pocket of the holster 30 is irregularly shaped.

Figure 3:
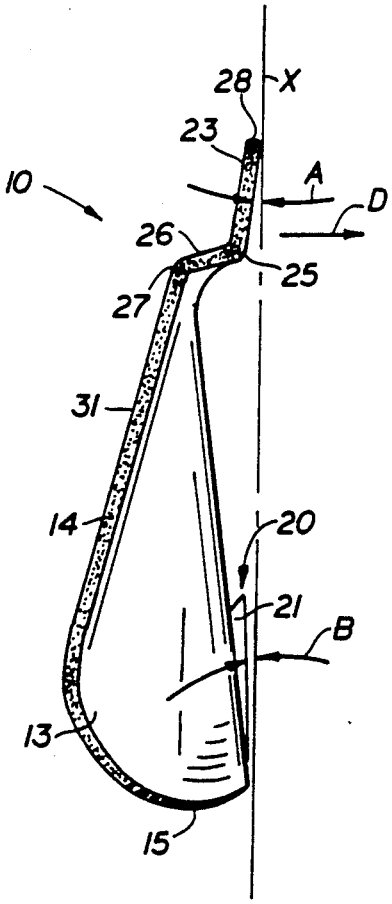
FIG. 3 is an enlarged view illustrating the paddle of FIG. 2.

As illustrated in FIG. 3, rectangular panel portion 23 is, before paddle 10 is secured to the side of a holster, at an angle A with respect to a vertical axis X. The flat planar smooth surface 21 is at an angle B with respect to vertical axis X. While paddle 10 can be formed from any desirable elastic or non-elastic material, paddle 10 is presently preferably comprised of a molded substantially rigid plastic. While this plastic is substantially rigid, it can be flexed due to the "L" figuration of panel portion 23 and panel member 26 to which the arcuate clamshell member is attached. Consequently, when panel portion 23 is attached to the side of a holster with screws 22, the lower portion of panel portion 23 is forced from its normal orientation of FIG. 3 toward the side of the holster in the direction of arrow D such that the inner surface of panel portion 23 is generally parallel to and pressed toward or against the side of the holster. When screws 22 tighten portion 23 toward the side of the holster the clamshell portion is flexed such that surface 21 is pressed against and contacts the side of the holster, and, such that panel portion 26 and the arcuate clamshell member are pulled toward side 11. As shown in FIG. 2, when holster 30 is viewed from the rear (or the front) surface 21 is preferably generally parallel to a vertically oriented line 40 which represents points on the outer surface or periphery of the side 11 of holster 30. When surface 21 is pressed against and is generally parallel to the side 11 of the holster, tooth 20 does not dig into the side of the holster or into the pants leg or other clothing of the user. Even though the "spring loading" which occurs to paddle 10 when paddle 10 is affixed to the side 11 of holster 30 forces surface 21 against the side of the holster 30, the portion of the pants leg which is between surface 21 and side 11 can slidably move short distances in between surface 21 and side 11. The ability of pants to slide intermediate surface 21 and side 11 permits the position of the pants with respect to paddle 10 to "float" or to automatically make small adjustments in response to movements of the leg and body of the user. The floating movement or adjustment of the pants portion intermediate surface 21 and side 11 can occur without tooth 20 digging into and possibly damaging the pants.

Figure 5:
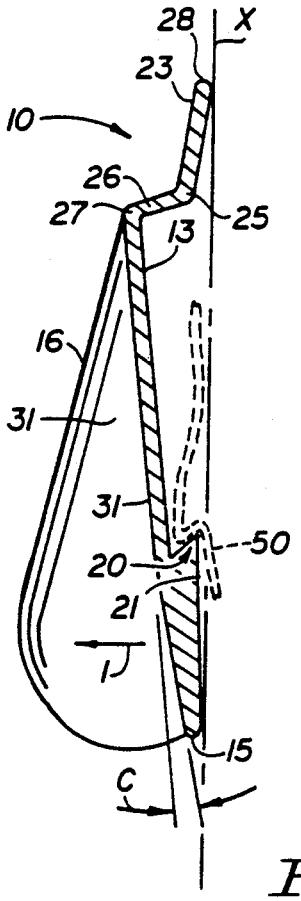
FIG. 5 is a side section view illustrating the holster paddle of FIG. 4 and taken along section lines 5—5 thereof; and, FIG. 6 is an edge view illustrating the paddle of FIG. 4.

On the other hand, if, after paddle 10 is slid over the belt and waistband and inside the pants of the user, holster 30 is pulled in the direction of arrow E in FIG. 2, then tooth 20 is tilted into the inner surface of the pants, increasing the angle of attack of the tooth 20 with respect to the pants. When the angle of attack of the tooth 20 is increased, the tooth better engages the pants because pants material 50 bunches over the tip of the tooth toward outer convex surface 13 of paddle 10. After pants material 50 bunches or folds over the tip of tooth 20, upwardly displacing holster 30 and paddle 10 in the direction of arrow F becomes much more difficult. Tooth 20 is particularly effective in engaging pants material after paddle 10 is pulled out in the direction of arrow E and up in the direction of arrow F and the tip or edge of tooth 20 is forced under the band of material which extends around the top or waist of the pants. The manner in which pants material 50 bunches over the tip of tooth 20 and inwardly and downwardly toward outer convex surface 13 is illustrated in FIG. 5. The paddle of the invention therefore snugly engages and slidably frictionally holds a portion of the pants intermediate the inner surface 21 and side 11 without continually pulling the pants fabric over the tip of tooth 20 to wear and damage the fabric. When holster 30 and tooth 20 are tilted from the normal operative position of FIG. 2 into the pants fabric, the tooth 20 engages the inside of the pants material so any wear which may occur is not visible.

If desired, two or more teeth 20 can be utilized on paddle 10. The angling of panel portion 23 (FIG. 5) with respect to vertical axis X (where X generally corresponds to the peripheral line 40 on the side 11 of holster 30 in FIG. 2) enables panel portion 23, elbow 25, panel member 26, elbow 27 and the arcuate clamshell member connected to elbow 27 to be flexed or "spring loaded" when panel portion 23 is tightened toward side 11 and edge means 20 is simultaneously pressed against side 11. The flexed paddle causes surface 21 to be pressed against side 11 of holster 30. Elbows 25 and 27 could be replaced with spring loaded hinges or other functionally equivalent structures, but the unitary molded plastic paddle 10 illustrated in FIGS. 1 to 6 is presently preferred in the invention. Planar surface 21 can, in part or in whole, be a convex or concave planar surface as long as surface 21 preferably (but not necessarily) performs the function of enabling pants material to be slidably moved intermediate surface 21 and side 11 of holster 30 when holster 30 is being worn by an individual during normal use. The shape and dimension of tooth (or teeth) 20 can be varied as desired. The upper edge of tooth 20 can be serrated, scalloped, etc. The edge or lip of tooth 20 is normally bevelled such that the edge will not cut the pants or other clothing of the user.

The inner surface 31 of the clamshell portion is shaped and dimensioned to generally contour to the leg, hip, or other selected portion of the body of the user. The outer surface 13 of the clamshell portion ordinarily is shaped and dimensioned to generally contour to the clothing of the user, but can be shaped to frictionally or otherwise engage the clothing or can be shaped to perform another function like, for example, protecting the body from a blow, a bullet, etc.

In use, the holster of FIGS. 1 and 2 is worn by the user by inserting the paddle 10 inside the top waist band of the user's pants or other garment and urging the holster downwardly until the holster is firmly seated with the top of the waist band bearing against panel member 26. When the holster of FIG. 2 is so seated a portion of the user's trousers extends intermediate surface 13 of paddle 10 and side 11. A section of the trousers is slidably pressed intermediate surface 21 and side 11. When the holster 30 is pulled out in the direction of arrow E and up in the direction of arrow F, surface 21 tilts away from side 11 in the direction of arrow I (FIG. 5), the angle of the attack of tooth means 20 with respect to the fabric comprising the pants is increased, and the fabric 50 tends to bunch over tooth 20 in the manner shown in FIG. 5. When fabric 50 bunches over tooth 20, tooth 20 is interlocked with fabric 50 and prevents the ready removal of holster 30 from the user's person.

Figure 4:
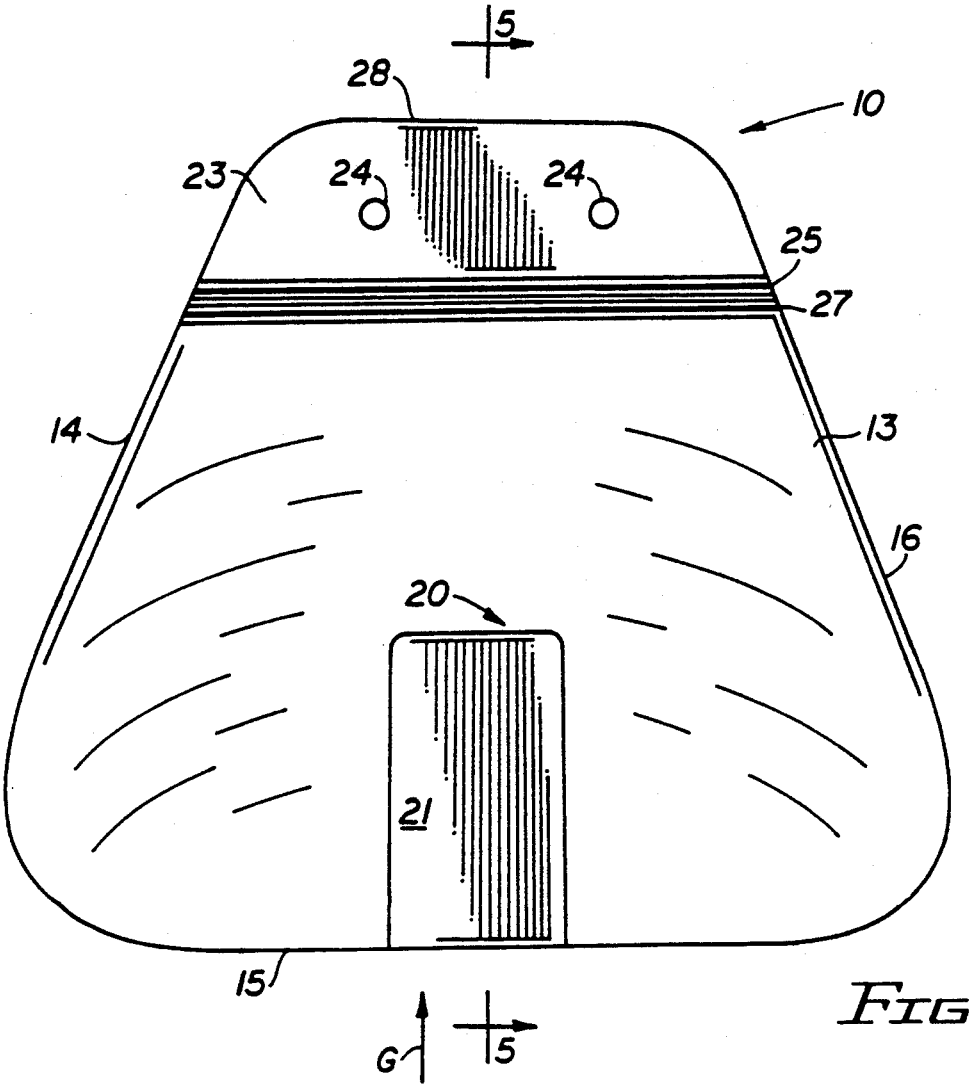
FIG. 4 is a front view illustrating the holster paddle of FIG. 3.
Figure 6:
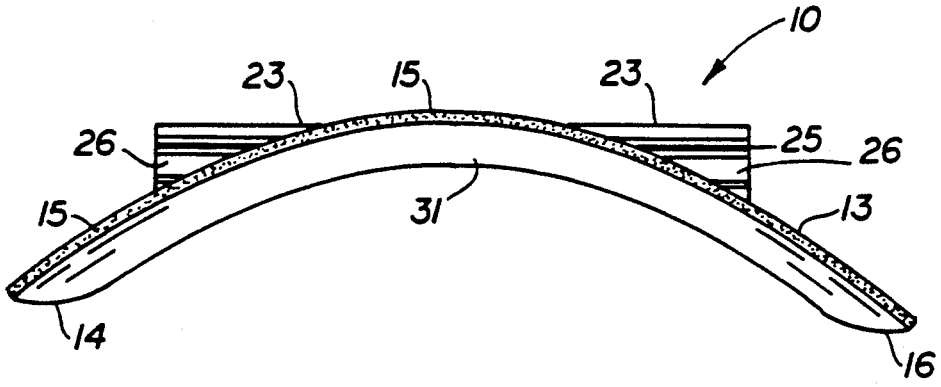

FIG. 6 is a view of the paddle of FIG. 4 taken from the perspective indicated by arrow G.

Inner surface 21 can be spaced apart from and not connected to tooth 20 as long as surface 21 functions to permit a portion of the user's pants to slide intermediate surface 21 and side 11 during normal wearing of the holster and as long as surface 21 maintains the tip of tooth 20 and surface in a common plane passing through line 40 in FIG. 2. Surface 21 functions to generally prevent fabric 50 from bunching over tooth 20 during normal wear of holster 30 and paddle 10. Normal wear conditions include sitting, running, walking, and moving while the holster and paddle remain seated on the waistband.

Having described my invention in such terms as to enable those skilled in the art to understand and practise it, and having identified the presently preferred embodiments thereof,

I Claim:

1. A holster for pistols comprising in combination (a) a pocket member shaped and dimensioned to slidably receive a pistol and including a first side (11) normally positioned to face the body of the holster user and a second side (12) normally positioned to face away from the body of the holster user;

(b) a mounting member (10) insertable at the waist inside the pants of the holster user to position a section of the pants intermediate said mounting member and said first side of said holster and including (i) a first portion attached to said first side of said pocket member, (ii) a second portion attached to said first portion and extending downwardly over and spaced apart from at least a part of said first side of said pocket member, and (iii) at least one tooth means extending outwardly from said second portion toward said first side of said holster and including a planar contact surface positioned against said first side, and an edge positioned above said planar surface and intermediate said planar surface and said first portion, said tooth means being shaped and dimensioned such that when said mounting member is inserted at the waist inside the pants of the holster user in a first normal operative position with said pocket member outside the pants, said planar surface is normally adjacent said first side and slidably contacts and presses said section of the pants against said first side, and said tooth edge is normally adjacent said first side such that the pants are prevented from bunching over said edge while said section slides intermediate said planar surface and said first side, and pocket member is pulled up and out from the body of the holster user and said first portion and second portion tilt away from the body of the holster user to move said pocket member and mounting member from said first operative position to a second operative position, said planar surface tilts away from the body of the holster user, and said edge tilts outwardly from the body of the holster user into the pants to increase the force exerted on the pants by said edge, improve the engagement of the pants by said edge, and facilitate the bunching of the pants over the edge.

2. The holster of claim 1 wherein said first and second portions and said tooth means are shaped and dimensioned such that said first and second portions spring load said planar surface of said tooth means against said first side of said pocket member when said mounting member and said pocket member are in said first operative position.

3. A holster for a holsterable object, said holster including (a) a pocket member shaped and dimensioned to slidably receive said holsterable object and including a first side (11) normally positioned to face the body of the holster user and a second side (12) normally positioned to face away from the body of the holster user;

(b) a mounting member (10) insertable at the waist inside the pants of the holster user to position a portion of the pants intermediate said mounting member and said first side of said holster and including (i) a first portion attached to said first side of said pocket member, (ii) a second portion attached to said first portion and extending downwardly over and spaced apart from at least a part of said first side of said pocket member, and (iii) at least one tooth means extending outwardly from said second portion toward said first side of said holster and including a planar contact surface positioned against said first side, and an edge positioned above said planar surface and intermediate said planar surface and said first portion;

said first and second portions and said tooth means being shaped and dimensioned such that said first and second portions spring load said planar surface of said tooth means against said pocket member and such that when said mounting member is inserted at the waist inside the pants of the holster user in a first normal operative position with said pocket member outside the pants, said planar surface is normally adjacent said firs side and slidably contacts and presses said section of the pants against said first side, and said tooth edge is normally adjacent said first side, and pocket member is pulled up and out from the body of the holster user and said first portion and second portion tilt away from the body of the holster user to move said pocket member and mounting member from said first operative position to a second operative position, said planar surface tilts away from the body of the holster user, and said edge tilts outwardly from the body of the holster user into the pants to increase the force exerted on the pants by said edge and improve the engagement of the pants by said edge.

4. A holster for a holsterable object, said holster including (a) a pocket member shaped and dimensioned to slidably receive said holsterable object and including a first side (11) normally positioned to face the body of the holster user and a second side (12) normally positioned to face away from the body of the holster user, said first side including an outer surface;

(b) a mounting member (10) insertable at the waist inside the clothing of the holster user to position a portion of the clothing intermediate said mounting member and said first side of said holster and including (i) a first portion attached to said first side of said pocket member, (ii) a second portion attached to aid first portion and extending downwardly over and spaced apart from at least a part of said first side of said pocket member, said second portion including an inner surface spaced apart from said outer surface of said first side (11), and (iii) at least one tooth means extending outwardly from said inner surface of said second portion toward said first side of said holster and including a planar contact surface positioned against said outer surface of said first side, and an edge positioned above said planar surface and intermediate said planar surface and said first portion;

said tooth means being shaped and dimensioned such that when said mounting member is inserted at the waist inside the pants of the holster user in a first normal operative position with said pocket member outside the pants, said planar surface is normally parallel and adjacent said first side and slidably contacts and presses said section of the pants against said outer surface of said first side, and said tooth edge is prevented by said planar surface from digging into said outer surface of said first side, and pocket member is pulled up and out from the body of the holster user and said first portion and second portion tilt away from the body of the holster user to move said pocket member and mounting member form said first operative position to a second operative position, said planar surface tilts away from the body of the holster user, and said edge tilts outwardly from the body of the holster user into the pants to increase the force exerted on the pants by said edge and improve the engagement of the pants by said edge.

* * * * *